US009211457B2

(12) United States Patent
Maeng et al.

(10) Patent No.: US 9,211,457 B2
(45) Date of Patent: Dec. 15, 2015

(54) GOLF-CLUB PROTECTIVE COVER HAVING AN OPENING AND CLOSING HOLDER FOR PROTECTING A GOLF CLUB

(71) Applicants: Seop Maeng, Gyeonggi-do (KR); Seoe Young Maeng, Seoul (KR)

(72) Inventors: Seop Maeng, Gyeonggi-do (KR); Seoe Young Maeng, Seoul (KR)

( * ) Notice: Subject to any disclaimer, the term of this patent is extended or adjusted under 35 U.S.C. 154(b) by 0 days.

(21) Appl. No.: 14/104,667

(22) Filed: Dec. 12, 2013

(65) Prior Publication Data

US 2014/0158566 A1 Jun. 12, 2014

(30) Foreign Application Priority Data

Dec. 12, 2012 (KR) ..... 10-2012-0144711
Sep. 16, 2013 (KR) ..... 10-2013-0110972

(51) Int. Cl.
*A63B 55/00* (2015.01)

(52) U.S. Cl.
CPC ..... *A63B 55/007* (2013.01)

(58) Field of Classification Search
CPC ..... A63B 55/00; A63B 55/007
USPC ..... 206/315.2, 315.3; 150/160
See application file for complete search history.

(56) References Cited

U.S. PATENT DOCUMENTS

| | | | | |
|---|---|---|---|---|
| 2,508,525 | A * | 5/1950 | Le Fevre | 150/160 |
| 2,705,039 | A * | 3/1955 | Halter | 150/160 |
| 3,117,609 | A * | 1/1964 | Pio | 150/160 |
| 3,664,399 | A * | 5/1972 | Neff | 150/160 |
| 4,195,677 | A * | 4/1980 | Hagg et al. | 150/160 |
| 5,050,655 | A * | 9/1991 | Borenstein | 150/160 |
| 6,119,742 | A | 9/2000 | Maeng et al. | |
| 6,202,723 | B1 | 3/2001 | Maeng et al. | |
| 6,874,627 | B2 * | 4/2005 | Maeng | 206/315.2 |
| 8,181,681 | B2 * | 5/2012 | Shin et al. | 150/160 |
| 2003/0213711 | A1 * | 11/2003 | Kang | 206/315.2 |
| 2004/0232040 | A1 * | 11/2004 | Bowling | 206/775 |
| 2009/0133790 | A1 * | 5/2009 | Maeng et al. | 150/160 |
| 2011/0073237 | A1 * | 3/2011 | Rajasingam | 156/60 |
| 2012/0074004 | A1 * | 3/2012 | Andochick | 206/315.6 |

FOREIGN PATENT DOCUMENTS

KR 100958526 B1 5/2010

OTHER PUBLICATIONS

Maeng, Seop et al., "A head cover for golf club," Espacenet, Publication Date: May 19, 2010; English Abstract of KR-10-0958526.

* cited by examiner

*Primary Examiner* — Sue A Weaver
(74) *Attorney, Agent, or Firm* — Millen, White, Zelano and Branigan, P.C.

(57) ABSTRACT

Disclosed herein is a golf-club protective cover having an opening and closing holder for protecting a golf club. The protective cover includes a main body having a pair of opening and closing plates that have a semi-circular section to receive a shaft of the golf club and a hinged joint portion on an end thereof so as to be hinged to each other, with a coil spring provided on the hinged joint portion to elastically bias the main body in a closing direction. A locking part is secured to one of the pair of opening and closing plates of the main body, thus locking or unlocking the opening and closing plates. The protective cover can reduce the number of manufacturing processes, simplify manufacturing work, and reduce labor. Further, a shape frame corresponding to each of golf clubs with various shapes is mounted to the main body.

1 Claim, 15 Drawing Sheets

GOLF-CLUB PROTECTIVE COVER HAVING AN OPENING AND CLOSING HOLDER FOR PROTECTING A GOLF CLUB

BACKGROUND OF THE INVENTION

1. Field of the Invention

The present invention relates, in general, to a golf-club protective cover having an opening and closing holder for protecting a golf club, and, more particularly, to a golf-club protective cover having an opening and closing holder for protecting a golf club, in which a main body performing an opening or closing operation and a shape frame opening or closing the golf-club protective cover in conjunction with the operation of the main body are separately formed, thus ensuring simplified manufacturing and low manufacturing cost and allowing the golf-club protective cover to be manufactured in various shapes conforming to shapes of respective golf clubs and thereby making it convenient to use, and in which a bending part for actuating a locking part is provided on the main body, so that the locking part is attached to the main body, thus ensuring a good operation and reducing the number of working processes and thereby allowing the golf-club protective cover to be manufactured at low cost, and in which the opening or closing operation of the main body is performed by a coil spring, thus guaranteeing a smooth operation, simplifying a manufacturing process, and reducing a cost for a spring, and in which a locking piece forcibly performing a locking operation to prevent opening of the protective cover is provided, so that the locking piece stays in a locked state when it is in operation, thus preventing the protective cover from being opened even if protective covers accidentally press a push button for opening or closing the protective cover when colliding with each other during transport or transfer, and thereby ensuring safe keeping of a golf club.

2. Description of the Related Art

Generally, various types of protective covers for golf clubs have been proposed. The protective cover for the golf club is mostly made of cloth and fitted over a head of the golf club G. As shown in FIG. 1, such a protective cover H is formed in the shape of a shank to surround both a head G2 and an upper portion of a shaft G1 of the golf club G, and is cut in a lengthwise direction thereof to allow the head G2 and the shaft G1 of the golf club to be easily inserted, with a slide fastener Z attached to a cut portion. Thereby, after the slide fastener Z attached to the protective cover H is opened, the golf club G is put into the protective cover H. Thereafter, the slide fastener Z is closed again. Then, it is possible to protect the head G2 and the upper portion of the shaft G1 of the golf club G. However, such a protective cover H is problematic in that the slide fastener Z should be opened or closed using both hands every time the golf club G is used, so that it is complicated and inconvenient to use the protective cover H.

In order to solve the problem, as shown in FIG. 2, a method of opening or closing a protective cover H' by bending it was proposed in U.S. Pat. No. 6,202,723 of the applicant of the present invention. However, this method is problematic in that it utilizes only an elastic force of the cover itself, so that an elastic restoring force is weak and thereby the opening or closing operation is not smoothly performed. If the thickness of the protective cover is increased, for example, if the protective cover is covered with protective cloth, the operation of the protective cover becomes worsened. In addition, when a user desires to open or close the protective cover, the protective cover should be bent. However, such a bending operation is not carried out smoothly, so that it is very difficult to perform the opening or closing operation with one hand. When the protective cover is opened to insert the golf club thereto, a hinge portion provided along a central axis of the protective cover rises up like a hump. Hence, it is inconvenient to put the golf club into the protective cover, and the golf club is pushed aside when received in the protective cover, due to the hump-shaped rising, thus causing inconvenience.

Further, as shown in FIG. 3, a protective cover according to U.S. Pat. No. 6,119,742 includes a hinge portion, and a pair of protective cover portions H that are hinged via a hinge pin. Thus, when the protective cover is opened, a hinge portion provided along the protective cover rises up like a hump, so that it is inconvenient to put the golf club into the protective cover, and the golf club is pushed aside when received in the protective cover, due to the hump-shaped rising, thus causing inconvenience. Further, a portion receiving a head of the golf club includes a top portion F1, a side portion F2, and a bottom portion F3 and is formed into a molded product by a molding process. However, because club heads vary in size depending on manufacturers and because the difference in size is considerable, such a molded product is incompatible with a wide range of golf clubs, so that it is inconvenient to use and several models are required. As a result, several types of molds should be manufactured, so that it is inconvenient to use.

In order to solve the problems, the applicant of the present invention proposed Korean Pat. No. 10-0958526. As shown in FIG. 4, a head cover H" for a golf club having an opening and closing frame according to the cited document includes a protective cover h1, an opening and closing wing h2, a U-shaped actuating bar h3, and elastic means h4. The protective cover h1 is made of fabric, and has a head portion covering a head of the golf club to protect it, and a shank portion extending downwards from the head portion to surround a shaft. The opening and closing wing h2 is fixedly inserted into the protective cover, and has an opening and closing hinge groove that extends longitudinally in such a way as to be opened or closed about the hinge groove. The U-shaped actuating bar h3 is provided on a middle portion in a longitudinal direction of the opening and closing wing h2, thus opening or closing the opening and closing wing h2. The elastic means h4 are provided on upper and lower portions of the opening and closing wing h2, respectively, to elastically bias the opening and closing wing h2 in a closing direction. However, the above-mentioned document is problematic in that the elastic means is made by fabricating a hard steel wire of spring steel into a special shape, so that its manufacturing cost is high, and besides, it is very difficult to anchor the hard steel wire. Further, since the opening and closing wing is inclined at a predetermined angle, it is difficult for a person with small hands to grasp the head cover. Furthermore, even when the head cover is closed, it may be slightly opened, so that marketability is poor. Moreover, it is very difficult to conform the head cover to the various shapes of different golf clubs. Further, this is problematic in that a locking part h5 is provided on an outer surface of the protective cover h1, so that several processes are required to attach the locking part to the protective cover h1 and thereby manufacturing cost thereof is significantly high, and as a result it is impossible, from a business perspective, for the cover to be profitable.

In order to solve the problems, as shown in FIG. 5, plate springs h6 are used to actuate the opening and closing wing h2. But, in the case of using the plate spring h6 as such, the manufacturing cost of the plate spring h6 is high and it is impossible to reuse the plate spring h6 if it is deformed, thus causing an inconvenience to a user. Further, it is very difficult to drill a hole through the plate spring h6 in the opening and closing wing h2 and besides it takes a long time to drill the hole, so that manufacturing time is increased. Especially when it is in use, noise is made because of friction between the plate spring h6 and the opening and closing wing h2, so that people tend to avoid its use.

DOCUMENTS OF RELATED ART (Patent Document 1) Korean Patent No. 10-0958526

SUMMARY OF THE INVENTION

Accordingly, the present invention has been made keeping in mind the above problems occurring in the related art, and an object of the present invention is intended to propose a golf-club protective cover having an opening and closing holder for protecting a golf club, in which a main body and a shape frame for opening or closing the golf-club protective cover in conjunction with the operation of the main body are separately formed, thus ensuring simplified manufacturing and low manufacturing cost, and in which the shape frame can vary a shape of the protective cover depending on the shape of a desired golf club, thus enabling the protective cover to be manufactured in various shapes.

Another object of the present invention is intended to propose a golf-club protective cover having an opening and closing holder for protecting a golf club, in which a locking part is installed in a main body, so that it is unnecessary to attach a separately manufactured locking part to the main body, thus reducing the number of manufacturing processes, ensuring a smooth operation, and eliminating malfunction or error, and thereby reducing manufacturing cost.

A further object of the present invention is intended to propose a golf-club protective cover having an opening and closing holder for protecting a golf club, in which a pair of opening and closing plates constituting a main body is operated by a coil spring, thus ensuring low manufacturing cost and simplified manufacturing.

Yet another object of the present invention is intended to propose a golf-club protective cover having an opening and closing holder for protecting a golf club, in which, even if an adjacent golf club or an iron collides with a push button that is pushed to open or close the protective cover, the protective cover can be kept closed during transport or movement.

In order to achieve the above objects, according to one aspect of the present invention, there is provided a golf-club protective cover having an opening and closing holder for protecting a golf club, in which it includes a main body having a pair of opening and closing plates that have a semi-circular section to receive a shaft of the golf club and a hinged joint portion on an end thereof so as to be hinged to each other, with a coil spring provided on the hinged joint portion to provide an elastic biasing force.

According to another aspect of the present invention, the golf-club protective cover may include a pair of shape frames, which are secured to upper portions of a pair of opening and closing plates of a main body, so that the shape frames are operated in conjunction with the opening or closing operation of the opening and closing plates.

According to a further aspect of the present invention, the golf-club protective cover may include a main body having a pair of opening and closing plates equipped with a coil spring, and a locking part is secured to one of the pair of opening and closing plates of the main body, thus locking or unlocking the opening and closing plates.

According to yet another aspect of the present invention, the golf-club protective cover may includes a protective cover having a main body installed therein to perform an opening or closing operation, the main body having a pair of opening and closing plates, with a coil spring secured to the pair of opening and closing plates to elastically support them, a push button that is provided on an associated opening and closing plate of the protective cover, serves to lock the opening and closing plates, is exposed to an outside in such a way as to be adjacent to an opening and closing part of the protective cover, and is operated to open or close the protective cover, and a locking piece that is movably secured to the push button, thus temporarily maintaining a locked state by extending across the opening and closing part of the protective cover.

As is apparent from the above description, the golf-club protective cover according to the present invention is advantageous in that it includes a main body having a pair of opening and closing plates that have a semi-circular section to receive a shaft of the golf club and a hinged joint portion on an end thereof so as to be hinged to each other, with a coil spring provided on the hinged joint portion to provide an elastic biasing force, and a locking part is secured to one of the pair of opening and closing plates of the main body to lock or unlock the opening and closing plates, thus reducing the number of manufacturing processes, ensuring simplified manufacturing, and reducing labor, and a shape frame having a shape corresponding to that of each of golf clubs with a variety of shapes, such as a wood, an iron, or a putter, is mounted to the main body, thus allowing the protective cover to be manufactured in various shapes and thereby being convenient to use, and a coil spring is used, thus reducing manufacturing cost, in addition to ensuring a reliable operation.

Further, the golf-club protective cover according to the present invention is advantageous in that a locking piece is movably secured to a push button that is provided adjacent to an opening and closing part of the protective cover, is exposed to an outside, and is operated to open or close the protective cover, thus temporarily maintaining a locked state by extending across the opening and closing part of the protective cover, and thereby keeping the protective cover closed even if an adjacent golf club or an iron accidentally collides with the push button that is pushed to open or close the protective cover, during transport or movement.

BRIEF DESCRIPTION OF THE DRAWINGS

The above and other objects, features and advantages of the present invention will be more clearly understood from the following detailed description taken in conjunction with the accompanying drawings, in which:

FIGS. 8A and 8B are sectional views taken along line I-I of FIG. 6A showing the opening and closing holder for protecting the golf club according to the first embodiment of the present invention, in which FIGS. 8A and 8B illustrate a locked state and an open state of an installed protective cover, respectively;

DESCRIPTION OF PREFERRED EMBODIMENTS

Figure 1:
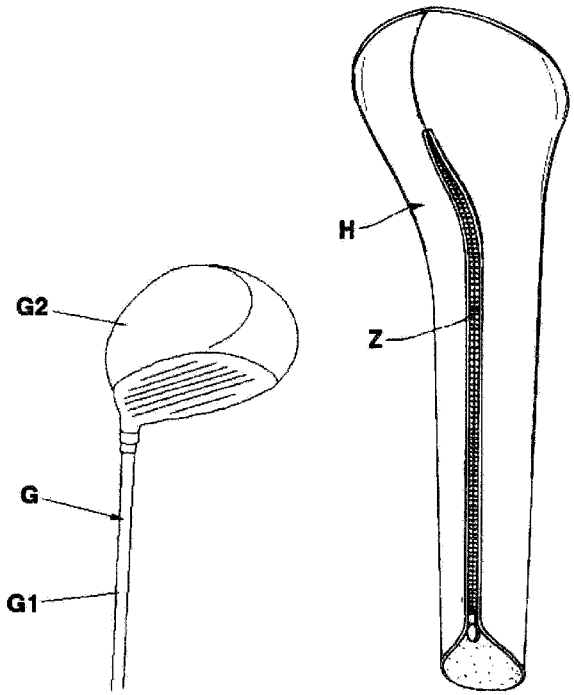
FIG. 1 is a perspective view showing a conventional protective cover for a golf club.
Figure 2:
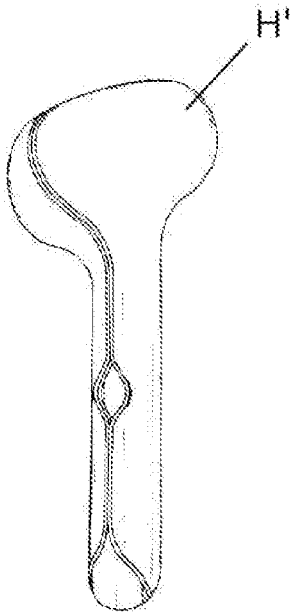
FIG. 2 is a perspective view showing another conventional protective cover for a golf club.
Figure 3:
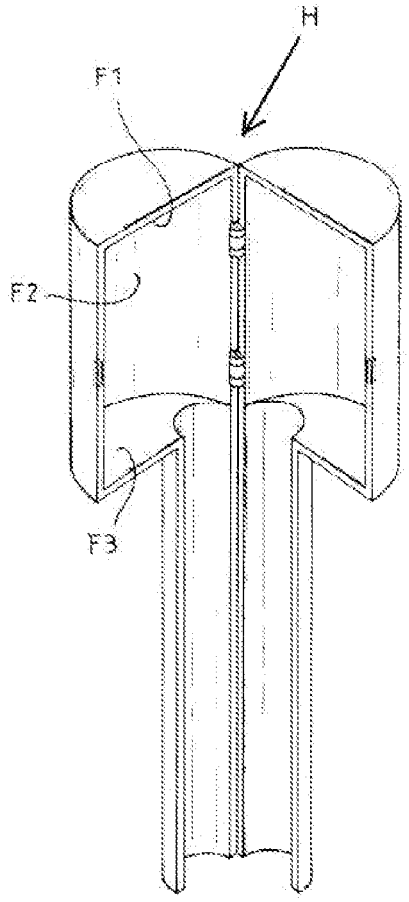
FIG. 3 is a perspective view showing a further conventional protective cover for a golf club.
Figure 4:
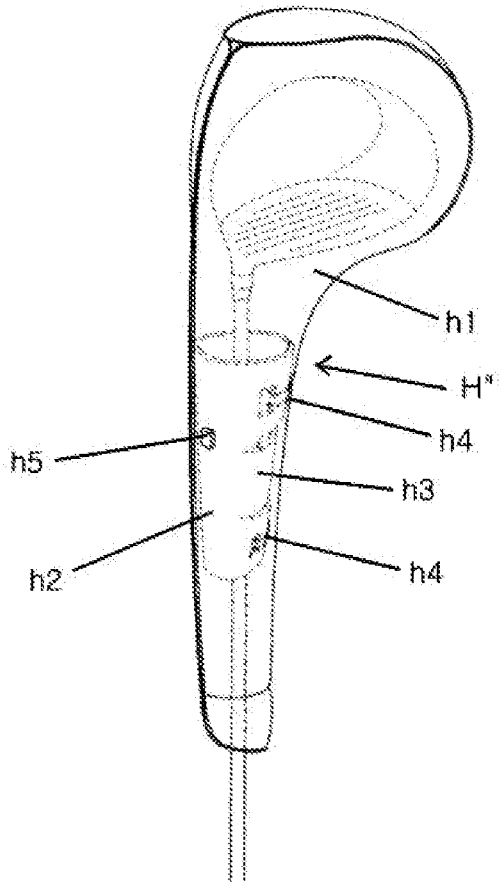
FIG. 4 is a perspective view showing a holder frame installed in yet another conventional protective cover for a golf club.
Figure 5:
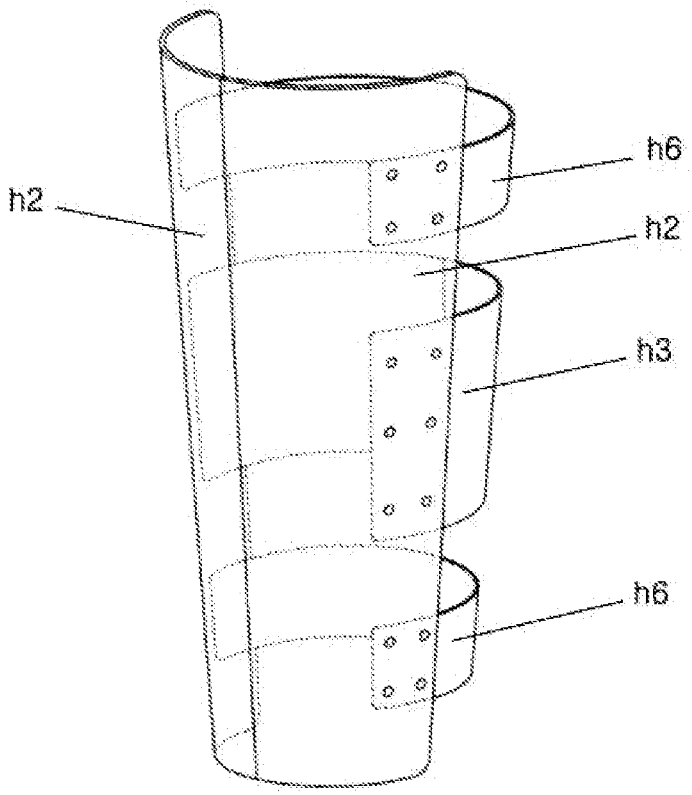
FIG. 5 is a schematic perspective view showing a conventional opening and closing wing using a plate spring.
Figure 6A:
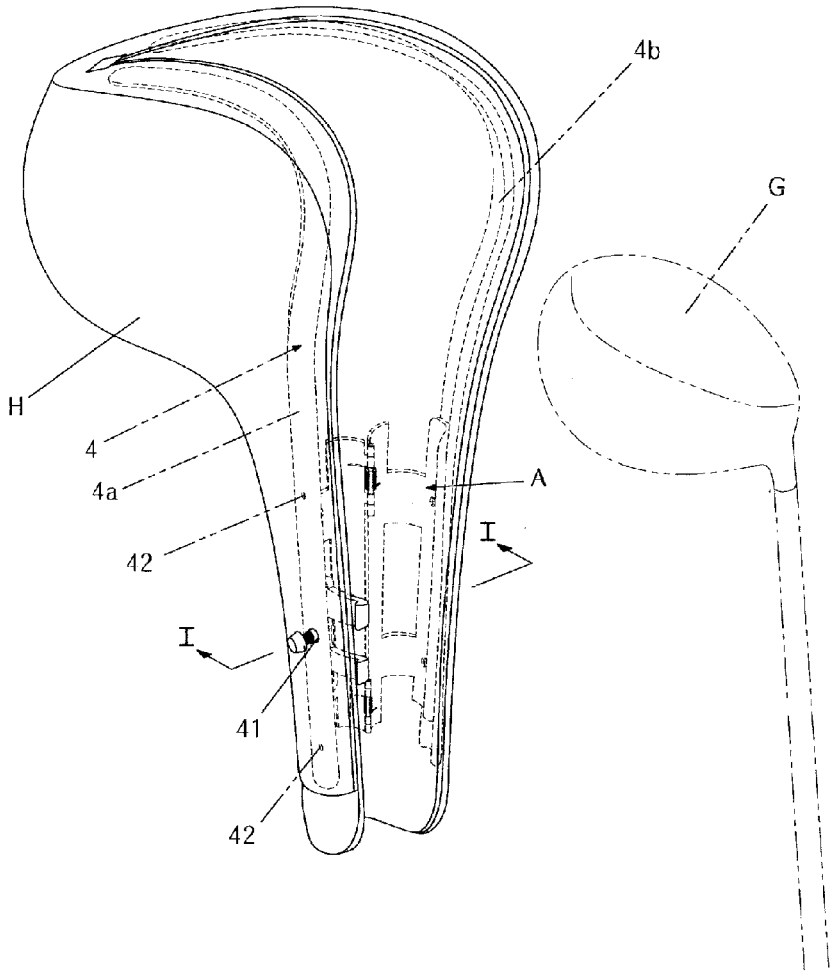
FIGS. 6A and 6B are a perspective view and an exploded perspective view showing an opening and closing holder for protecting a golf club according to a first embodiment of the present invention.
Figure 6B:
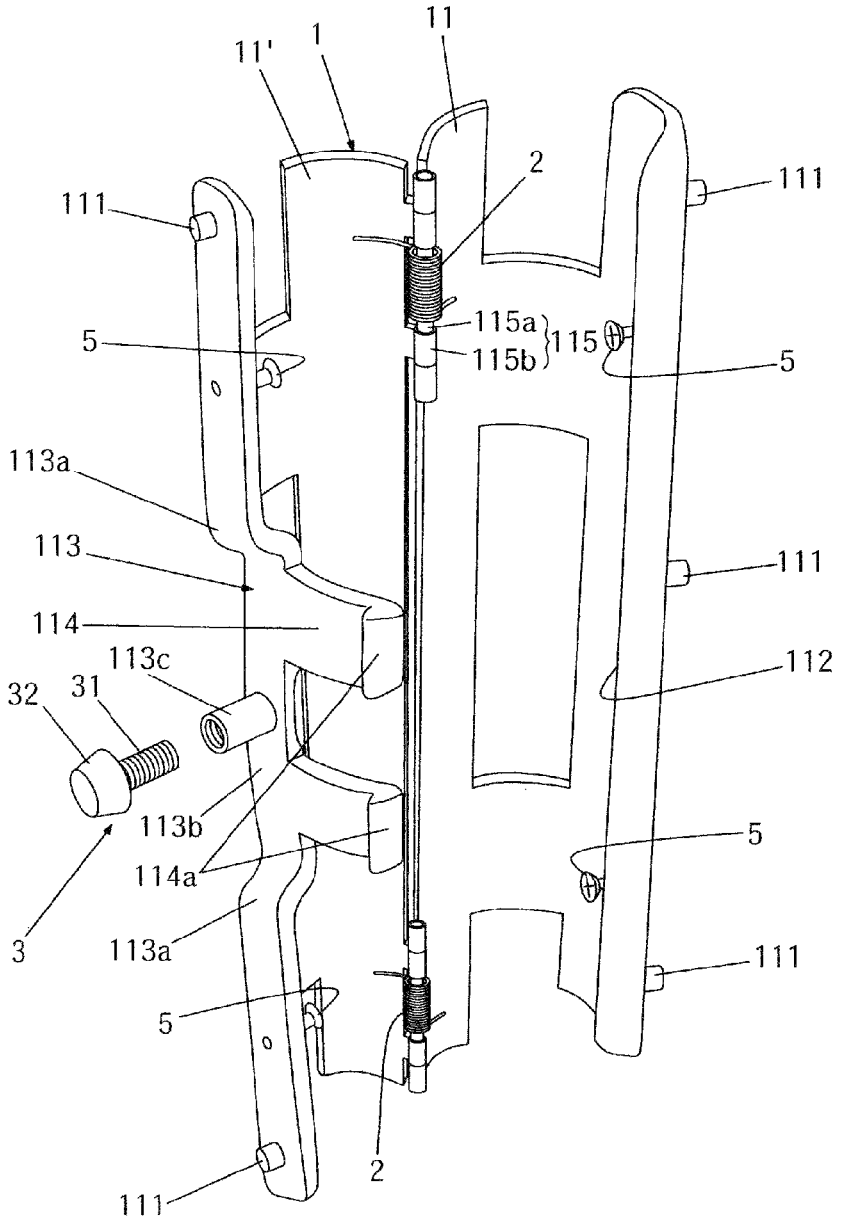
Figure 7:
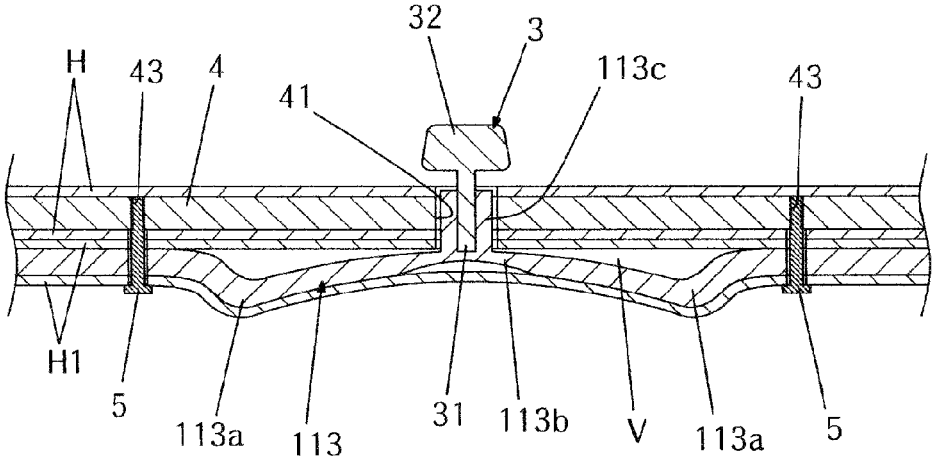
FIG. 7 is a longitudinal sectional view showing an opening and closing plate equipped with a locking part of the opening and closing holder for protecting the golf club according to the first embodiment of the present invention.

As shown in FIGS. 6A, 6B and 7, an opening and closing holder A for protecting a golf club according to a first embodiment of the present invention is provided in a golf-club protective cover H to receive a golf club G by opening or closing the golf-club protective cover H.

The opening and closing holder A for protecting the golf club includes a main body 1 having a pair of opening and closing plates 11 and 11 that are actuated to be opened or closed, a coil spring 2 elastically supporting the pair of opening and closing plates 11 and 11' to enable opening operation thereof, and a locking part 3 provided on an associated opening and closing plate 11' and serving to lock the opening and closing plates 11 and 11'.

As shown in FIG. 6B, the main body 1 is configured such that hinged joint surfaces provided on first side ends of the pair of opening and closing plates 11 and 11' each having a semi-circular section are connected to each other and are elastically supported by the coil spring 2 to be opened, with a connecting protrusion 111 protruding from a surface of a free end of the opening and closing plate to be connected to a shape frame 4. The locking part 3 and a catching part 114 are provided on a surface of a free end of the opening and closing plate 11', while a catching step 112 is provided on the free end of another opening and closing plate 11 to catch the catching part 114 that is actuated by the locking part 3. The hinged joint surfaces provided on the first side ends of the pair of opening and closing plates 11 and 11' are hinged by a hinge part 115 having a hinge shaft 115*a* and a hinge hole 115*b* to perform an opening or closing operation. Since the hinge shaft 115*a* is fixedly inserted into the coil spring 2, it is very easy to install the coil spring 2.

As shown in FIG. 7, on a surface of the free end of the opening and closing plate 11' equipped with the locking part 3 is provided a bending part 113. The bending part 113 is deeply bent downwards at both ends thereof to form a curved portion 113*a* that has a space V thereabove, with a central portion 113*b* being formed on a center of the bending part 113 in such a way as to convexly protrude upwards. Thereby, the entire shape of the bending part 113 is convexly curved from a lower surface of the shape frame 4. A push rod 113*c* protrudes from a center of a top of the bending part 113 to fasten the locking part 3 thereto.

The catching part 114 is formed on a side of the bending part 113 in such a way as to protrude towards another opening and closing plate 11, the catching part 114 having on an end thereof a catching hook 114*a* that is caught by the catching step 112 provided on the free end of another opening and closing plate 11 (see FIG. 6B).

The coil spring 2 secured to the hinged joint surface of the main body 1 to elastically bias the opening and closing plate 11 in an opening direction uses a coil spring to enable inexpensive manufacture. Since it is easy to purchase the coil spring 2, its manufacturing cost becomes low. Further, even though the coil spring 2 is repeatedly used several times, its function does not diminish, thus ensuring good durability. This embodiment describes that the coil spring 2 biases the opening and closing plate in its opening direction. However, of course, the coil spring 2 may elastically bias the opening and closing plate 11 in a closing direction.

The locking part 3 is detachably provided on a surface of the free end of the opening and closing plate 11', and includes a fastening portion 31 secured to the upper end of the push rod 113*c* that is in contact with the central portion 113*b* of the bending part 113 of the opening and closing plate 11' and protrudes outwards, and a push button 32.

In this embodiment, the shape frame 4 includes a pair of curved round shape frames 4*a* and 4*b* to receive a wood. A through hole 41, an insertion hole 42 and a fastening hole 43 are formed in one shape frame 4*a*, while an insertion hole 42 and a fastening hole 43 are formed in the other curved round shape frame 4*b*. Thus, as shown in FIG. 7, the opening and closing plate 11 is coupled with the protective cover H being interposed, and the opening and closing plate 11, the protective cover H, and the shape frame 4 are reliably integrally coupled to each other by a fastening screw 5.

Figure 9:
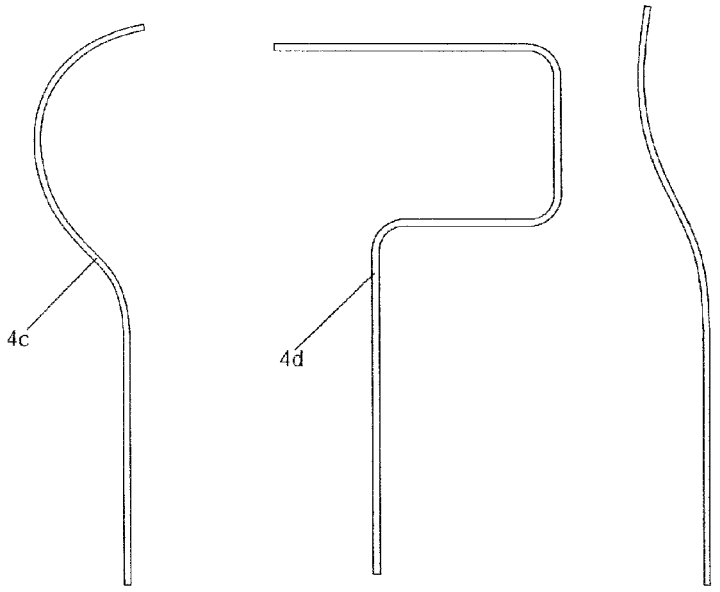
FIG. 9 is a perspective view showing a shape frame of the opening and closing holder for protecting the golf club according to the first embodiment of the present invention.

This embodiment proposes the curved round shape frames 4*a* and 4*b* having a shape suitable for protecting a golf club, as the shape frame 4. However, in order to receive an iron or a putter, as shown in FIG. 9, a protruding round shape frame 4*c* having a round shape whose upper portion protrudes may be proposed, or in order to receive a putter, a hammer-shaped shape frame 4*d* may be proposed. Since the shape frame 4 can be formed in various shapes as such, it is easy to manufacture protective covers of shapes that correspond to various kinds of golf clubs, owing to several shapes of the shape frame 4.

Figure 10:
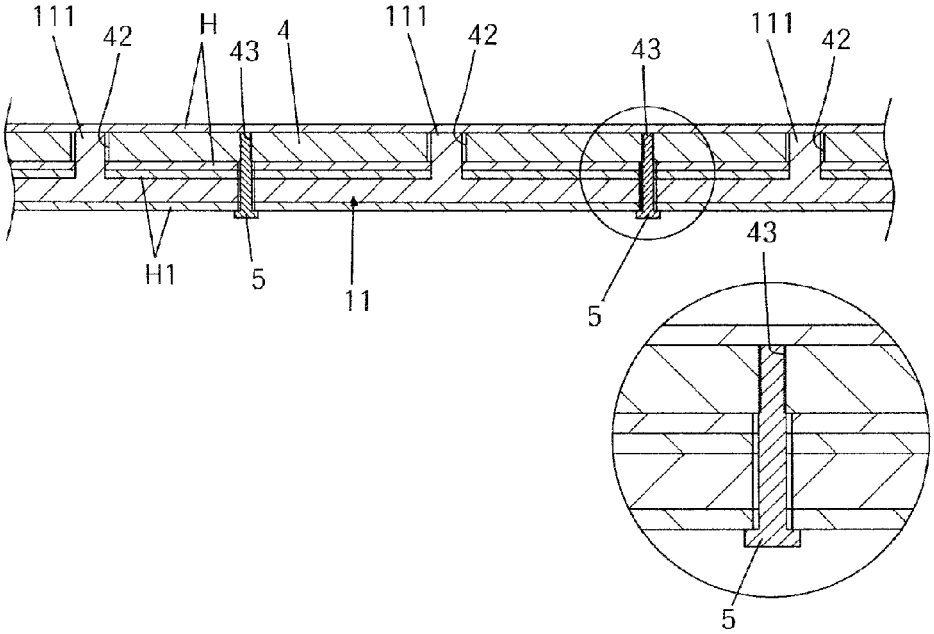
FIG. 10 is a schematic longitudinal sectional view showing the opening and closing plate coupled to the shape frame of the opening and closing holder for protecting the golf club according to the first embodiment of the present invention.

As shown in FIG. 10, a shape frame is provided with the insertion hole 42 to couple such a shape frame 4 to the connecting protrusion 111 that protrudes from the surface of the free end of the opening and closing plate 11, 11'. The shape frame 4 is surrounded by the protective cover H, a protective cover H1 of another fabric fixedly surrounds the main body 1, the connecting protrusion 111 is inserted into the insertion hole 42, and the fastening screw 5 is fitted into the fastening hole 43 to reliably integrate the opening and closing plate 11, the protective cover H, and the shape frame 4 with each other.

An operation of the opening and closing holder A for protecting the golf club according to the present invention configured as described above will be described below in detail. First, since the locking part 3 is integrally provided on the opening and closing plate 11' of the main body 1, a process of mounting the locking part, manufactured separately from the main body, on the protective cover is omitted unlike in the prior art. Thus, if the opening and closing plates 11 and 11' are coupled to the shape frame 4 in the protective cover H and then the coupling of the locking part 3 is performed, that is, the fastening portion 31 of the locking part 3 is fastened to the push rod 113*c* of the bending part 113, the installation of the locking part 3 is completed. Consequently, attaching work, such as sewing, for mounting the separate locking part 3 on the protective cover H is omitted, thus making it very convenient to manufacture the opening and closing holder A for protecting a golf club.

Further, the coil spring 2 has been installed at the opening and closing plates to elastically support the pair of opening and closing plates. Since the coil spring 2 is not easily broken, it can be used for a lengthy period of time. Hence, manufacturing labor is reduced, thus resulting in low manufacturing cost.

Figure 8A:
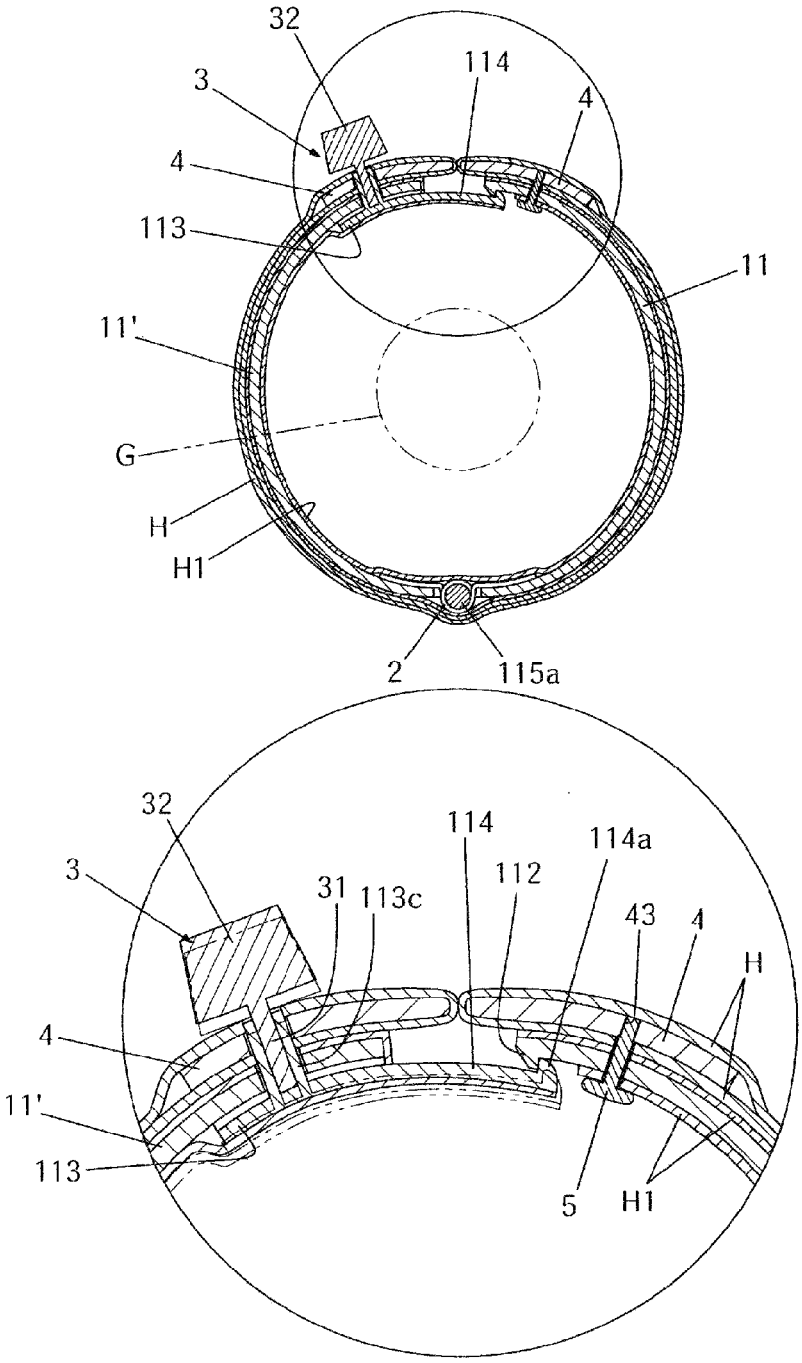
Figure 8B:
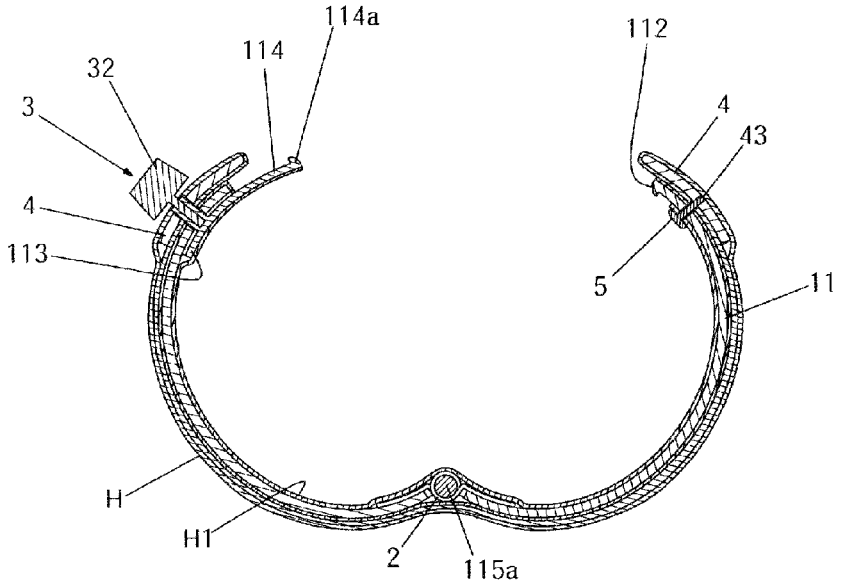

The operation of the opening and closing holder A for protecting the golf club according to the present invention is as follows. As shown in FIG. 8A, when a user desires to open the closed opening and closing holder A for protecting the golf club, the push button 32 of the locking part 3 is pushed down. At this time, the push rod 113*c* of the bending part 113 is subjected to force to be moved down, and then the convexly protruding central portion 113*b* of the bending part 113 is moved down to be located horizontally on the curved portion 113*a*. Thereby, the catching part 114 connected to a surface of the bending part 113 is moved down, so that the catching hook 114*a* is released from the catching step 112 of another opening and closing plate 11, and simultaneously the opening operation is performed by the elastic force of the coil spring 2 (shown by two-dot chain line of FIG. 8A). Thus, as the bending part 113 is pushed by the locking part 3, the main body 1 is changed from the closed state to the open state, so that the protective cover H is opened. That is, the protective cover H is opened as shown in FIG. 8B. In this case, the upper end of the protective cover H into which the head of the golf club G is inserted becomes wider than the main body 1 to be opened, by the curved portion provided on the upper end of the shape frame 4 secured in the protective cover H. Accordingly, it is also easy to insert the golf club G having a large head, such as a driver, into the protective cover.

The curved portions 113*a* are formed at both ends of the bending part 113 in such a way as to have the space V, while the central portion 113*b* is near enough to come into contact with the lower surface of the shape frame 4 without the space V. This provides a structure that can be used for a lengthy period of time without a failure. Since such a locking part 3 is provided on the main body 1, the opening and closing holder A for protecting the golf club can be manufactured conveniently and at low cost.

Figure 11:
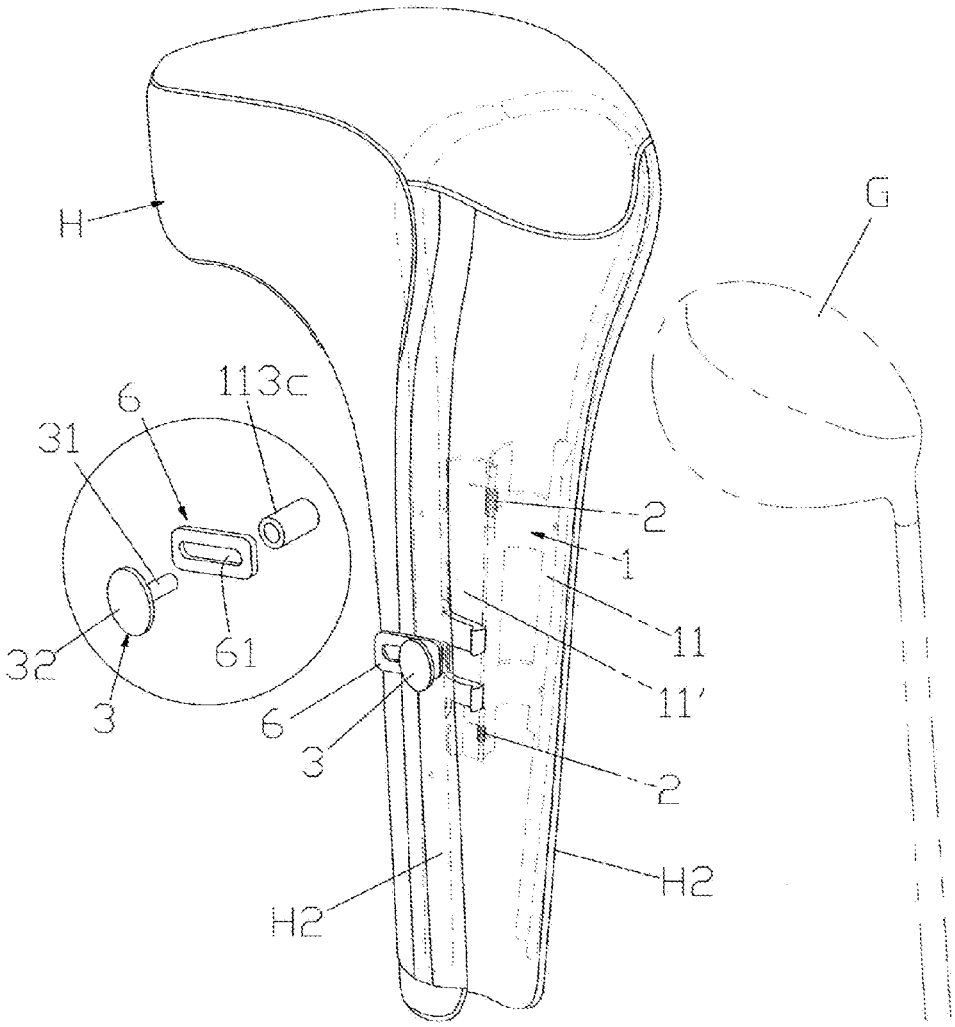
FIG. 11 is a perspective view showing an open state of a protective cover for a golf club according to a second embodiment of the present invention.
Figure 12:
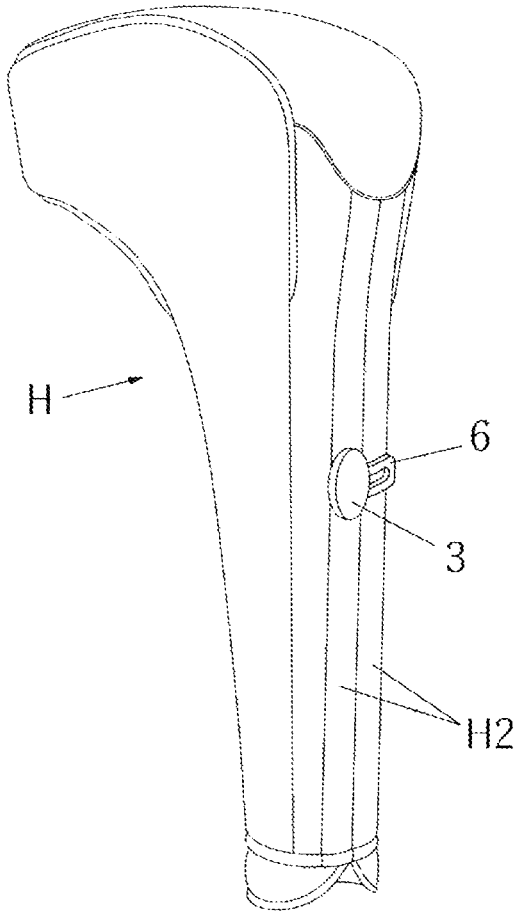
FIG. 12 is a perspective view showing a closed state of the protective cover for the golf club according to the second embodiment of the present invention.

A golf-club protective cover H according to a second embodiment of the present invention is configured as shown in FIGS. 11 and 12. That is, a main body 1 is installed in the protective cover H to open or close it, and includes a pair of opening and closing plates 11 and 11' and a coil spring 2 elastically supporting the opening and closing plates 11 and 11' to perform an opening operation. A locking part 3 is provided on an opening and closing plate 11' that is installed in the protective cover H, thus serving to lock the opening and closing plates 11 and 11'. The locking part 3 is installed adjacent to opening and closing parts H2 of the protective cover H in such a way as to be exposed to the outside, and is actuated to open or close the protective cover H. A locking piece 6 is movably secured to the locking part 3 to temporarily maintain a locked state by extending across the opening and closing parts H2 of the protective cover H.

The locking part 3 is detachably provided on a surface of the free end of the opening and closing plate 11', and includes on a lower portion thereof a fastening portion 31 secured to the upper end of the push rod 113*c* that is in contact with the central portion of the opening and closing plate 11' and protrudes outwards, and a push button 32 formed on a top of the fastening portion 31. Since the installing method or the configuration of the locking part 3 are described in detail in FIG. 6B, a detailed description thereof will be omitted.

Figure 13A:
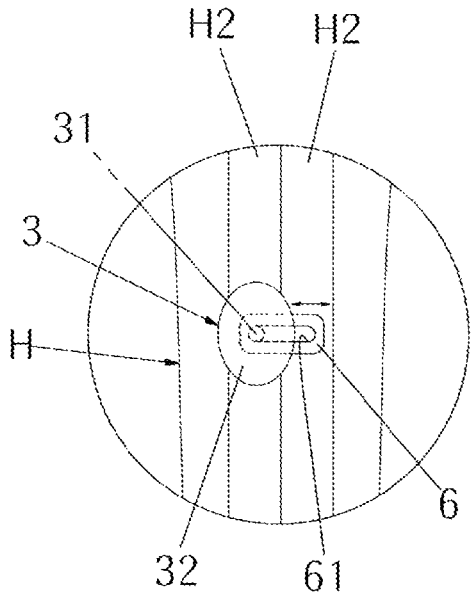
FIGS. 13A and 13B are front views, respectively, showing a closed state and an open state of the protective cover for the golf club according to the second embodiment of the present invention.
Figure 13B:
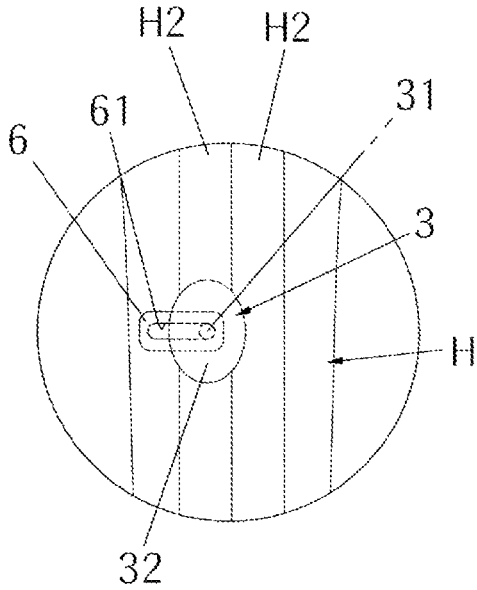

According to this embodiment, a locking piece 6 having a lateral sliding groove 61 therein is secured to the fastening portion 31 of the locking part 3 by insertion, so that it is moved along the fastening portion 31 to close the golf-club protective cover H by extending across the opening and closing parts H2 (see, FIG. 13A) or to open the golf-club protective cover H (see, FIG. 13B).

That is, the golf-club protective cover H according to the second embodiment of the present invention is configured as follows: For example, when the golf club is carried with its head G received in the golf-club protective cover H, in the state where the fastening portion 31 of the locking part 3 is inserted into the locking piece 6 in such a way as to move laterally, the locking piece 6 is moved rightwards along the fastening portion 31 as shown in FIG. 13A, so that the locking piece 6 extends across the opening and closing parts H2 of the golf-club protective cover H. Thus, even if the locking part 3 is undesirably operated by an impact sufficient to open the golf-club protective cover H, the locking piece 6 extends across the opening and closing parts H2, so that the golf-club protective cover H never opens and is safely carried while the cover maintains a closed state. In order to use the golf club that has been carried as such, the locking piece 6 is moved leftwards along the fastening portion 31, as shown in FIG. 13B. Then, the locking piece 6 is held only on one opening and closing part H2 of the golf-club protective cover H, so that the protective cover H can be opened by pushing the locking part 3, thus allowing the golf club G to be taken out from the golf-club protective cover H.

Figure 14:
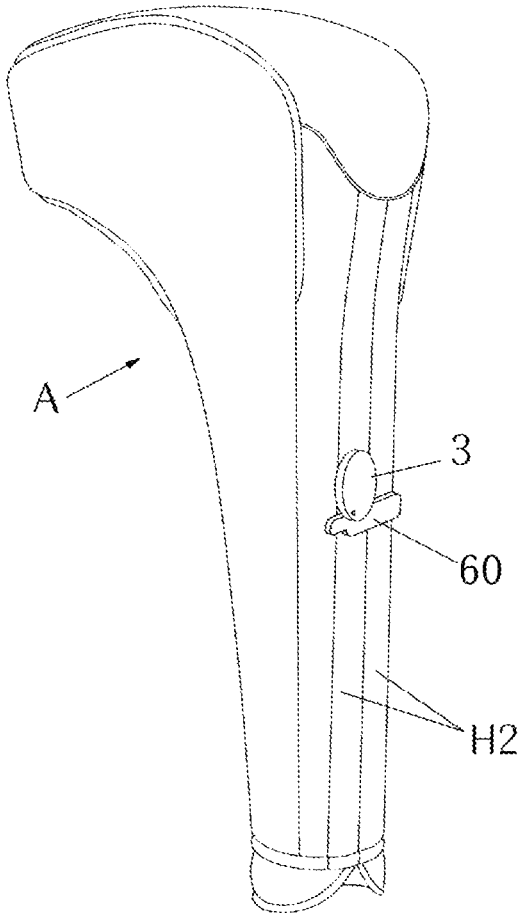
FIG. 14 is a perspective view showing a closed state of a protective cover for a golf club according to a third embodiment of the present invention.
Figure 15A:
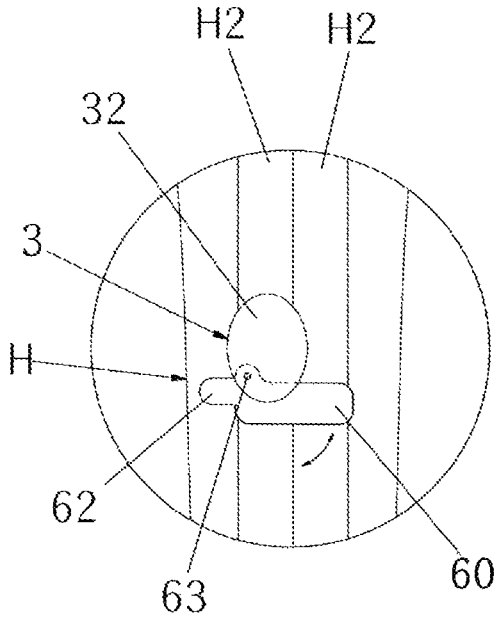
FIGS. 15A and 15B are front views, respectively, showing a closed state and an open state of the protective cover for the golf club according to the third embodiment of the present invention.
Figure 15B:
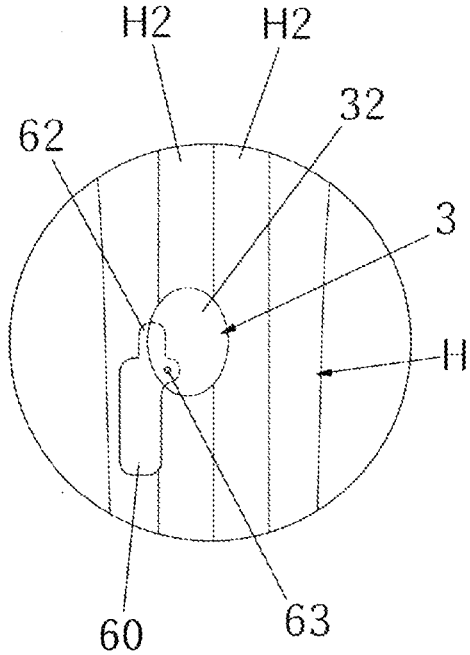

A golf-club protective cover H having a locking piece according to a third embodiment of the present invention is configured as shown in FIG. 14 and FIGS. 15A and 15B. The basic configuration of the third embodiment remains the same as the second embodiment except that a locking piece 60 is hinged to a lower surface of a push button 32 of a locking part 3 via a hinge shaft 63. Thus, as shown in FIG. 15A, if a handle 62 provided on a side of the locking piece 60 is pushed counterclockwise or a lower portion of the locking piece 60 is turned counterclockwise, the locking piece 60 rotates about the hinge shaft 63 counterclockwise and thus extends across both opening and closing parts H2 of the protective cover H, thus locking the protective cover H. In contrast, as shown in FIG. 15B, if the handle 62 is turned clockwise, the locking piece 60 rotates about the hinge shaft 63 clockwise and thus is held only on one opening and closing part H2, so that the protective cover H is ready to open. In such a state, if the locking part 3 is pushed, the protective cover H is opened, thus allowing the golf club G to be taken out from the protective cover H.

Therefore, the golf-club protective cover according to the present invention is configured so that the locking piece is movably secured to the push button that is installed adjacent to the opening and closing part of the protective cover, is exposed to the outside, and is operated to open or close the protective cover. Thus, when the locking piece is in a locked position, the protective cover can maintain a closed state even if an adjacent golf club or iron accidentally collides with the push button for opening or closing the protective cover during transport or movement.

As described above, the present invention provides an opening and closing holder for protecting a golf club, which enables the same kind of product to be repeatedly produced in an industrial field for manufacturing a general protective cover for a golf club, thus affording industrial availability.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A golf-club protective cover having an opening and closing holder for protecting a golf club, the opening and closing holder provided in the golf-club protective cover to receive a golf club by opening or closing the golf-club protective cover and comprising:

a main body having a pair of first and second opening and closing plates that are actuated to be opened or closed;

a coil spring elastically supporting the opening and closing plates to enable opening operation thereof;

a locking part provided on the first opening and closing plate and serving to lock the opening and closing plates, wherein the main body of the opening and closing holder for protecting the golf club is configured such that hinged joint surfaces provided on first side ends of the opening and closing plates each having a semi-circular section are connected to each other and are elastically supported by the coil spring, with a connecting protrusion protruding from a surface of a free end of the second opening and closing plate configured to be connected to a first shape frame of a pair of shape frames, the locking part is provided on a surface of a free end of the first opening and closing plate, and a catching step is provided on the free end of the second opening and closing plate to catch a catching part on the free end of the first opening and closing plate that is moved by the locking part, the pair of shape frames is provided in the protective cover and is coupled to the main body via coupling means including the connecting protrusion, and the pair of shape frames having several shapes that correspond to various kinds of golf clubs, and each shape frame is provided with an insertion hole and a fastening hole.

* * * * *